US006264520B1

(12) United States Patent
Yamazaki et al.

(10) Patent No.: US 6,264,520 B1
(45) Date of Patent: Jul. 24, 2001

(54) METHOD OF AND APPARATUS FOR SEALING COLOR CATHODE-RAY TUBE

(75) Inventors: Tatsuya Yamazaki; Maki Yoshida, both of Kitaadachi-gun; Shoichi Yokoyama, Fukaya; Kazumasa Hirayama, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/361,991

(22) Filed: Jul. 28, 1999

(30) Foreign Application Priority Data

Jul. 29, 1998 (JP) ..... 10-214462

(51) Int. Cl.[7] ..... H01J 9/42
(52) U.S. Cl. ..... 445/4; 445/64
(58) Field of Search ..... 445/3 A, 4, 34, 445/64

(56) References Cited

U.S. PATENT DOCUMENTS 4,148,117 * 4/1979 Bracke et al. ..... 445/4
4,189,814 * 2/1980 Ottos ..... 445/4
4,604,071 * 8/1986 Pons ..... 445/4

* cited by examiner

*Primary Examiner*—Kenneth J. Ramsey
(74) *Attorney, Agent, or Firm*—Oblon, Spivak, McClelland, Maier & Neustadt, P.C.

(57) ABSTRACT

A laser beam is emitted form one side to a pair of square holes, while an electron gun assembly is being rotated on the tube axis of a color cathode-ray tube. The resulting diffraction pattern is sensed. When diffraction images included in the diffraction pattern are processed and a zero-order diffraction image and at least a first-order diffraction image are sensed in the pattern, the distance between the center of the zero-order diffraction image and the center of the first-order diffraction image is measured. The rotational position at which the distance is the smallest is sensed. The electron gun assembly is rotated to the position and held in place. Consequently, high-speed positioning is done with high rotation accuracy, which helps manufacture high-quality color cathode-ray tubes.

12 Claims, 6 Drawing Sheets

METHOD OF AND APPARATUS FOR SEALING COLOR CATHODE-RAY TUBE

BACKGROUND OF THE INVENTION

This invention relates to a method of and apparatus for sealing a color cathode-ray tube, and more particularly to a method of and apparatus for sealing a color cathode-ray tube used for the process of sealing the electron gun assembly of a color cathode-ray tube.

A color cathode-ray tube comprises a funnel-shaped glass bulb with a panel, or a vacuum envelope, and an in-line electron gun assembly inserted in the neck of the bulb in such a manner that it is held in a specific position. FIG. 1 shows a color cathode-ray tube obtained after the electron gun assembly 12 has been inserted in the bulb 11 and the bulb has been sealed.

In such a color cathode-ray tube, when the electron gun assembly 12 that generates three electron beams for RGB, or red, green, and blue, is sealed, it is desirable that an imaginary line X—X passing through the center of each of three electron beam holes 12*r*, 12*g*, and 12*b* made in an electron gun electrode 12*a* shown in FIG. 2 should be aligned with an imaginary line (a reference line in a horizontal plane) H—H in the direction of the major axis passing through the center of a rectangular screen of the bulb 11 shown in FIG. 1. FIG. 4 shows a state where imaginary line X—X does not align with imaginary line H—H and crosses the latter at an angle of θ, or a misaligned state in a twisted manner.

For monitors used with the recent personal computers, the standard for rotation known as twist has become severer.

Imaginary line X—X and imaginary line H—H do not exist in reality. Therefore, in actual adjustment, imaginary line H—H is defined as a parallel line to a pad face 13 of the bulb 11 shown in FIG. 1 and imaginary line X—X is determined using one side face in the direction of the major axis of the electron gun assembly 12 of FIG. 2 as a reference face. The electron gun assembly 12 is provided in the neck of the bulb 11 in such a manner that imaginary line H—H aligns with imaginary line X—X. Then, the air is exhausted from the bulb 11. Thereafter, the neck is sealed.

A method of assembling a color cathode-ray tube by providing such an electron gun assembly 12 in the bulb 11 has been disclosed in, for example, Jpn. Pat. Appln. KOKOKU Publication No. 61-20106. In the assembly, the position of the electron gun assembly 12 is determined as described below in detail and provided in the neck.

As shown in FIG. 1, an electron gun electrode 12*a* shown in FIG. 2 is connected electrically and mechanically to a stem section 16 with stem pins 15 provided in the lower part, forming an electron gun assembly 12, which is provided in the bulb 11. Specifically, as shown in FIG. 3, the electron gun electrode 12*a* is provided on the stem section 16 in such a manner that imaginary line X—X passing through three electron beam holes 12*r*, 12*g*, and 12*b* made in the electron gun electrode 12*a* crosses, at right angels, imaginary line Y—Y passing through a pair of top and bottom stem pins 15*a*, 15*a* serving as a reference. When the electron gun electrode 12*a* is connected to the stem section 16, it is ideal that imaginary line X—X should cross imaginary line Y—Y accurately at right angles. In actual assembly, however, there arises a small twist error.

The position of the electron gun assembly 12 put together as described above is measured and inserted in the bulb 11. When the electron gun assembly 12 is inserted in the bulb 11, the electron gun assembly 12 is placed in a specific position. In the positioning, a pair of square holes 14, 14 made in both side faces of the electron gun electrode 12*a*, one hole in each face is used. Specifically, a laser beam is emitted from one side of the pair of square holes 14, 14 and pass through the square holes. Then, the diffraction images of the square holes 14, 14 are sensed. When the diffraction images form a specific pattern, the electron gun assembly 12 is so set that it has a specific location with respect to the screen. Thereafter, the neck in which the electron gun assembly 12 has been provided is sealed.

In the method disclosed in Jpn. Pat. Appln. KOKOKU Publication No. 61-20106, an electron gun assembly 12 with a pair of square holes 14, 14 in both side faces of an electron gun electrode 12*a* is mounted on a rotating adjustment table (not shown) as shown in FIG. 2. The rotating adjustment table can rotate on the center axis Z—Z of the bulb 11 combined with the electron gun assembly 12 and is so set that it has a specific positional relationship with a holding unit (not shown) for holding the bulb 11.

Next, a laser beam is generated in such a manner that the center axis Z—Z crosses the direction of optical axis at right angles. The laser beam is emitted from one side of the pair of square holes 14, 14. The laser beam passes through the pair of square holes 14, 14 and is projected on a sensor (not shown). The sensor monitors the diffraction pattern formed as a result of the laser beam passing through the square holes 14, 14. The diffraction images are displayed on a monitor television. Then, the rotating adjustment table is manually rotated until the displayed diffraction images have formed a specific image, thereby adjusting the angle of the electron gun assembly 12.

Thereafter, the bulb 11 is so held by the holding unit that imaginary line H—H of the bulb 11 is placed in a specific position at which line H—H aligns with the optical axis of the laser beams. In this state, the electron gun assembly 12 is inserted in the neck of the bulb 11 as shown in FIG. 1. Thereafter, the electron gun assembly 12 is sealed in the bulb 11 by a burner (not shown).

In such an assembly method, the aligning of the direction of rotation of the electron gun assembly 12 is done by the operator who turns the adjusting screw serving as the driving mechanism of the rotating adjustment table, while watching a monitor television. Therefore, the result of adjustment varies greatly, depending on the operator. Consequently, it is difficult to seal the electron gun assembly 12 with high accuracy.

BRIEF SUMMARY OF THE INVENTION

The object of the present invention is to provide a method of and apparatus for sealing a color cathode-ray tube capable of making alignment at high speed with high rotation accuracy without variations in the result depending on the operator and of improving the quality of the color cathode-ray tube.

The foregoing object is accomplished by providing a color cathode-ray tube sealing method of positioning an electron gun assembly with respect to the screen of a color cathode-ray tube and sealing the assembly in the neck portion of the color cathode-ray tube, comprising the steps of: rotating the electron gun assembly on the tube axis of the color cathode-ray tube; emitting a laser beam from one of a pair of square holes facing each other made in the electron gun assembly, with the electron gun assembly in the rotated state; receiving, outside the other square hole, a diffraction pattern produced by the laser beam passed through the holes;

aligning the electron gun assembly by stopping the rotation of the assembly when the received diffraction image has become a preset desired image.

While the electron gun assembly is being rotated on the tube axis of the color cathode-ray tube, the laser beam is emitted from one side to the pair of square holes made in the electron gun assembly. The resulting diffraction images are received and processed. The image-processed diffraction images are subjected to arithmetic operations. This enables highly accurate positioning to be done at high speed without variations in the result depending on the operator. As a result, it is possible to provide a color cathode-ray tube with high picture quality.

The state where the center-to-center distance or side-to-side distance between the zero-order diffraction image of the square hole and diffraction images of interference fringes of the first order or higher is the smallest is set as the desired pattern in the aligned state.

Furthermore, the state where the center-to-center distance or side-to-side distance between first-order diffraction images appearing on both sides of the image of the square hole corresponding to the zero-order diffraction image is the smallest is set as the desired pattern in the aligned state.

Additionally, when the state where the center-to-center distance or side-to-side distance between first-order diffraction image and second-order distance is the smallest has been sensed, this means that the desired pattern in the aligned state has been sensed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Hereinafter, referring to the accompanying drawings, a color cathode-ray tube according to an embodiment of the present invention will be explained. In FIGS. 5 to 11, the same parts as those in the conventional equivalent of FIGS. 1 to 4 are indicated by the same reference symbols.

Figure 5:
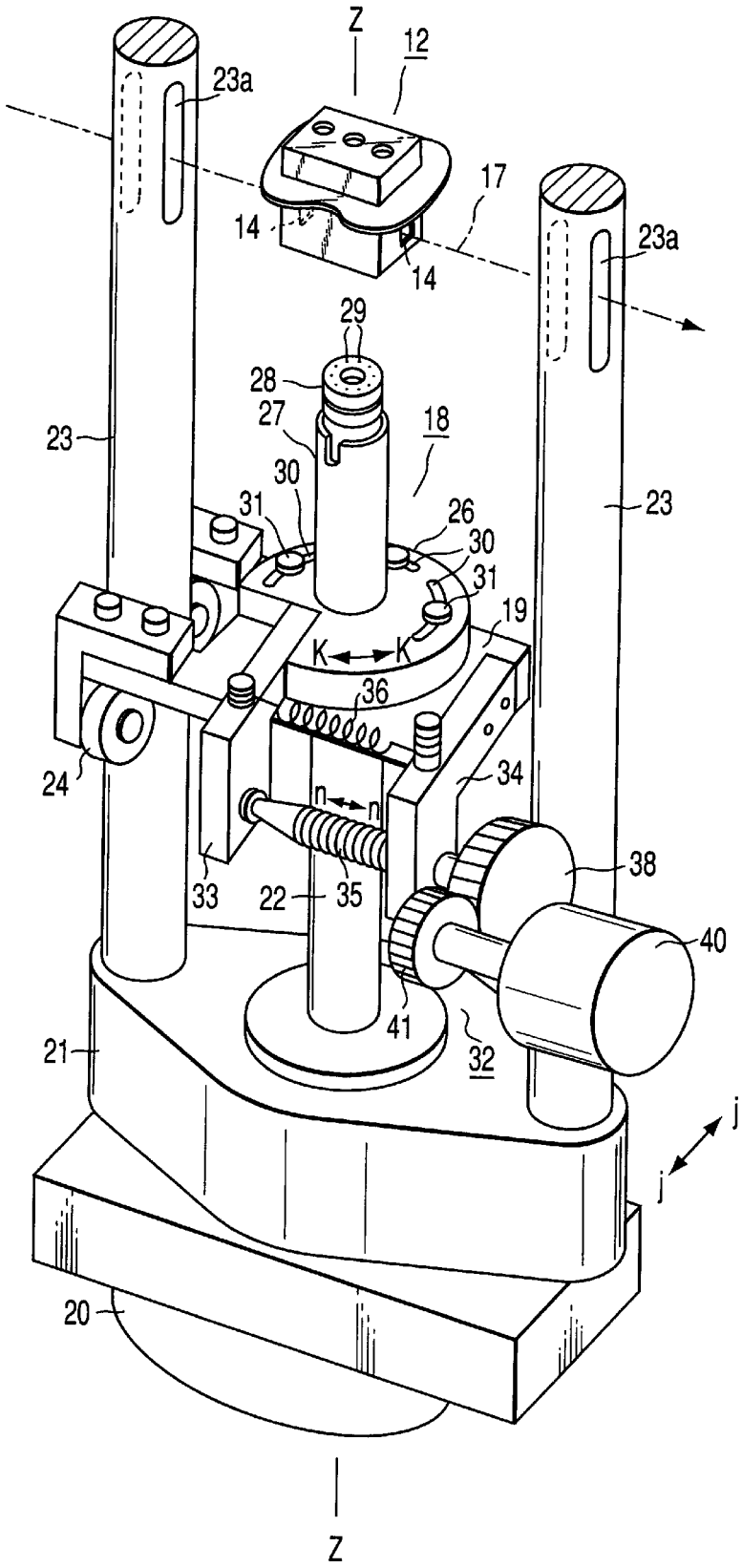
FIG. 5 is a schematic perspective view showing the mechanism of a sealing apparatus for a color cathode-ray tube according to an embodiment of the present invention.

FIG. 5 shows a mechanism for positioning the electron gun assembly 12 in a color cathode-ray tube sealing apparatus by using a laser beam 17. In FIG. 5, numeral 18 indicates a rotating adjustment table for adjusting the direction of the electron gun assembly 12 by rotating it. The rotating adjustment table 18 is mounted on a flange 19 in such a manner that it can rotate together with the flange 19 in the direction of rotation K—K, with the center axis Z—Z of a bulb (not shown) as the center of rotation. The flange 19 is provided integrally at the top end of a mount rod 22 supported by a base 20 and a support stand 21 in such a manner that it can move up and down. A pair of stanchion rods 23, 23 is planted integrally on both sides of the support stand 21, one on one side. The flange 19 has two pairs of rollers 24 provided so as to sandwich the stanchion rods 23, one pair for one stanchion rod. As a result of the rollers 24 running on the stanchion rods 23, the flange 19 is moved up and down using the stanchion rods 23 as a guide.

The rotating adjustment table 18 has a rotating disk 26 and a cylindrical section 27 so provided integrally in the central portion of the rotating disk 26 that it rises straight. At the top end of the cylindrical section 27, a mount chip 28 is integrally provided. In the mount chip 28, small holes 29 have been made which support the stem pins (not shown) provided on the electron gun assembly 12. Namely, the electron gun assembly 12 is mounted integrally on the mount chip 28 in such a manner that the stem pins are inserted into the small holes 29.

In the rotating disk 26, rectangular-shaped or elongated holes 30 are made in the direction of rotation k—k. Screws 31 passing through the elongated holes 30 are screwed into the flange 19. As a result, the range of rotation of the rotating disk 26 is limited to the range of length of the rectangular-shaped hole 30.

A rotating mechanism 32 for rotating the rotating adjustment table 18 will be explained.

An actuating strip 33 extending in the direction of radius of the rotating disk 26 is provided integrally on the rotating disk 26. The actuating strip 33 is so placed that one side of its end faces one side of the end of a support strip 34 provided integrally on the flange 19. The tip of an adjustment screw 35 pressed against the side of the actuating strip 33 is screwed into the support strip 34. A spring 36 stretched between the actuating strip 33 and support strip 34 forces the tip of the adjustment screw 35 to make pressure contact with the actuating strip 33. Furthermore, a gear 38 is provided integrally at the base end of the adjustment screw 35. The gear 38 is engaged with an output gear 41 provided on a servo motor acting as a rotational driving source, such as a pulse motor 40. The pulse motor 40 is supported by a holding and moving mechanism (not shown) in such a manner that it can be moved in the j—j direction to allow the engagement of the gear 38 with the output gear 41 to be canceled arbitrarily.

In the rotating mechanism 32 having such a configuration, when the pulse motor 40 rotates the adjustment screw 35 and the tip of the adjustment screw 35 moves back and forth in the n—n direction, the rotating adjustment table 18 having the rotating disk 26 is rotated via the actuating strip 33 in an arbitrary direction, with axis Z—Z as the center.

In the upper end of the pair of stanchion rods 23, 23, elongated holes 23*a*, 23*a* for allowing a laser beam 17 to pass through have been made. A laser source for emitting a laser beam 17 is provided in such a manner that the laser beam 17 passes through a pair of square holes 14, 14 in the electron gun assembly 12 mounted on the rotating adjustment table 18. To sense the laser beam passed through the elongated holes 23*a*, 23*a* and square holes 14, 14, a sensing device, such as a CCD camera (not shown), is provided on the laser optical path on the opposite side to the laser source.

Furthermore, a holding unit (not shown) for a bulb 11 combined with the electron gun assembly 12 is provided at the upper ends of the pair of stanchion rods 23, 23. The holding unit holds the bulb 11 in such a manner that imaginary line H—H of FIG. 6 aligns with the direction of optical axis of the laser beam 17.

Figure 6:
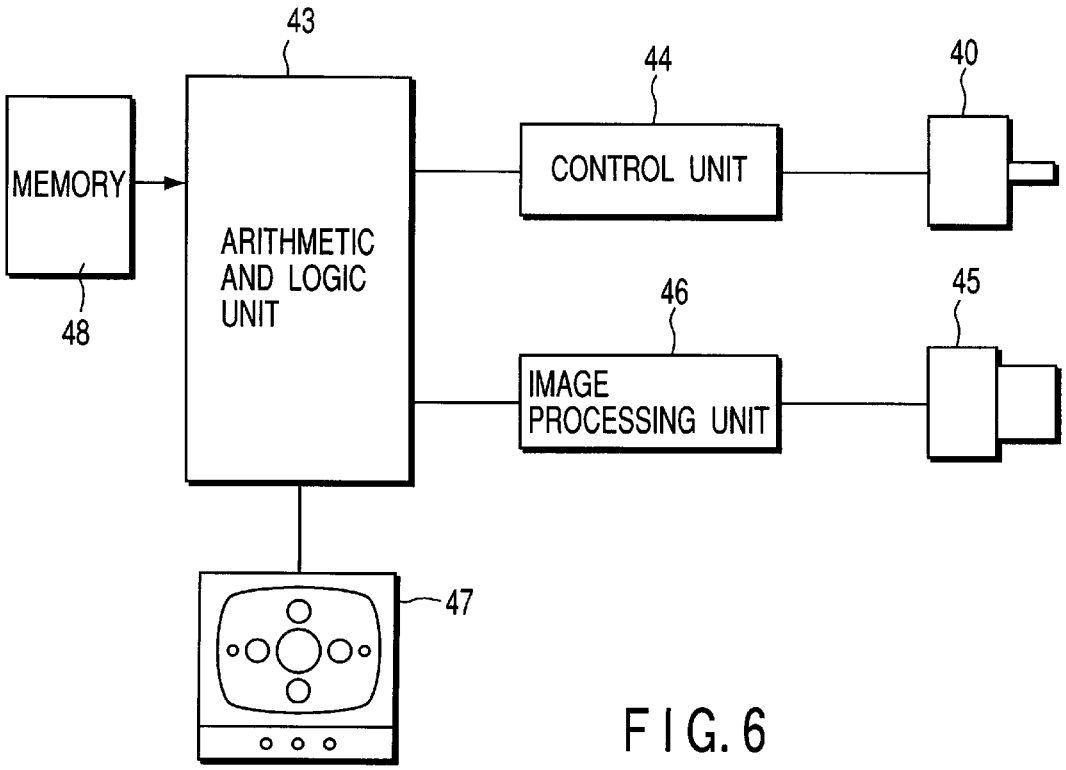
FIG. 6 is a block diagram of the control system in the sealing apparatus of FIG. 5.

FIG. 6 shows a block diagram of a control system for controlling the positioning mechanism of FIG. 5. A control unit 44 provides on/off control of the pulse motor 40 in the rotating mechanism 32 of FIG. 5 on the basis of an instruction from an arithmetic and logic unit 43. After an image processing unit 46 has processed the image signal from a CCD camera 45 for sensing a diffraction pattern generated by the laser beam 17, the resulting signal is inputted to the arithmetic and logic unit 43.

Furthermore, the CCD camera 45 monitors diffraction images produced by the laser beam 11 passed through the square holes 14, 14 in the electron gun assembly 12 and outputs the monitored image signal. The image signal is processed by the image processing unit 46 and the resulting signal is inputted to the arithmetic and logic unit 43. The diffraction images are displayed on a monitor television 47 connected to the arithmetic and logic unit 43.

Here, the principle of positioning the electron gun assembly 12 using the laser beam 17 will be explained.

Figure 7:
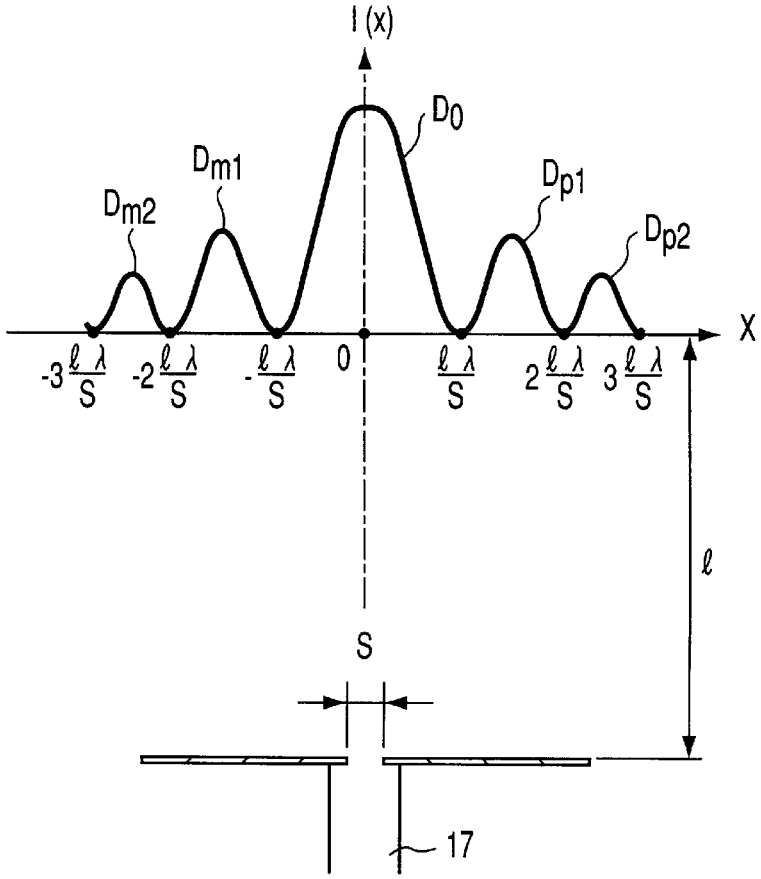
FIG. 7 is an explanatory diagram showing the light intensity distribution of a diffraction pattern sensed by the CCD camera acting as the sensor of FIG. 6.

AS shown in FIG. 7, when the laser beam 17 has passed through a slit with a width of S, the light intensity distribution (the density distribution along the x-axis ) of the diffraction images on a light-receiving surface a distance of 1 away from the slit is expressed by equation 1:

$$I(x)=[\{\sin(\pi S/1\lambda)x\}/\{(\pi S/1\lambda)x\}]^2 \quad (1)$$

where the wavelength of the laser beam 11 is λ.

FIG. 7 is an explanatory diagram for the intensity distribution in the direction of the x-axis. The intensity distribution on the light-receiving surface is a function of the width S of the slit, the wave-length λ, and the distance 1 between the slit and the light-receiving surface. As shown in FIG. 7, when $\pm n\cdot 1\cdot\lambda/S$ (n=1, 2, 3, . . . ), the intensity becomes zero. As the width S of the slit become greater, the zero point gets closer to the center.

Figure 8:
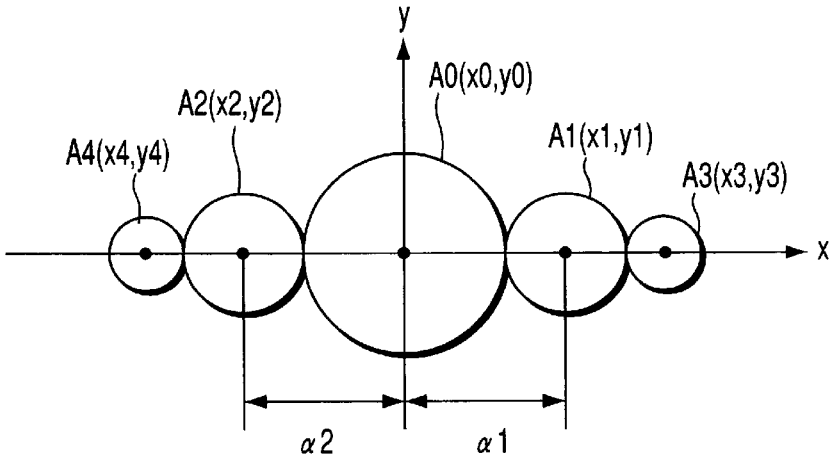
FIG. 8 is a plan view showing the light intensity distribution of a diffraction pattern sensed by the CCD camera acting as a sensor in FIG. 6.

FIG. 8 is a plan view of the light intensity distribution in the X—Y plane, where a circular striped pattern appears in right-to-left symmetry. In FIG. 8, if the center of the large circle (a zero-order diffraction image) in the middle is A0(x0, y0), and the centers of the adjacent circles (first-order diffraction images) on the right and left sides of the large circle are A1(x1, y1) and A2(x2, y2), respectively, the distances α1 and α2 between the center of the large circle in the middle and the adjacent circles will be expressed by $\alpha 1=|x1-x0|$ and $\alpha 2=|x2-x0$, respectively.

Therefore, if the square hole 14 in the electron gun assembly 12 of FIG. 5 is used as the slit shown in FIG. 7, the laser beam 17 pointed at the square hole 14 will have the greatest width passing the square hole, or the laser beam 17 passing through the square hole will have the highest intensity, when the optical axis of the laser beam 17 becomes perpendicular to the plane of the square hole 14. At this time, imaginary line X—X of the electron gun assembly 12 aligns with the optical axis of the laser beam 17. When the electron gun assembly 12 thus positioned has been inserted in the neck portion of the bulb 11 and sealed therein, this means that the electron gun assembly 12 has been sealed in the bulb 11 in an ideal state where the electron gun assembly 12 has been aligned with the bulb 11 accurately under the conditions where imaginary line H—H of the bulb 11 is decided so that it may align with the optical axis of the laser beam 11 as described above. That is, by finding the position in the direction of rotation of the electron gun assembly at which the distances α1 and α2 become the smallest, the electron gun assembly 12 is positioned ideally with respect to the bulb 11.

Since the laser beam 17 passes through the square holes 14, 14, the actual diffraction pattern also appears in the vertical direction (in the direction of Y) of FIG. 8 (not shown in FIG. 8), with the result that a cross form appears on the sensor like the image on the monitor television 47 of FIG. 6. To adjust the rotation of the electron gun assembly 12, attention has only to be given to the image of the cross-shaped diffraction pattern in the horizontal direction (the direction of x). Thus, use of only the diffraction pattern in the direction of x enables the positioning of the electron gun assembly 12.

Figure 9:
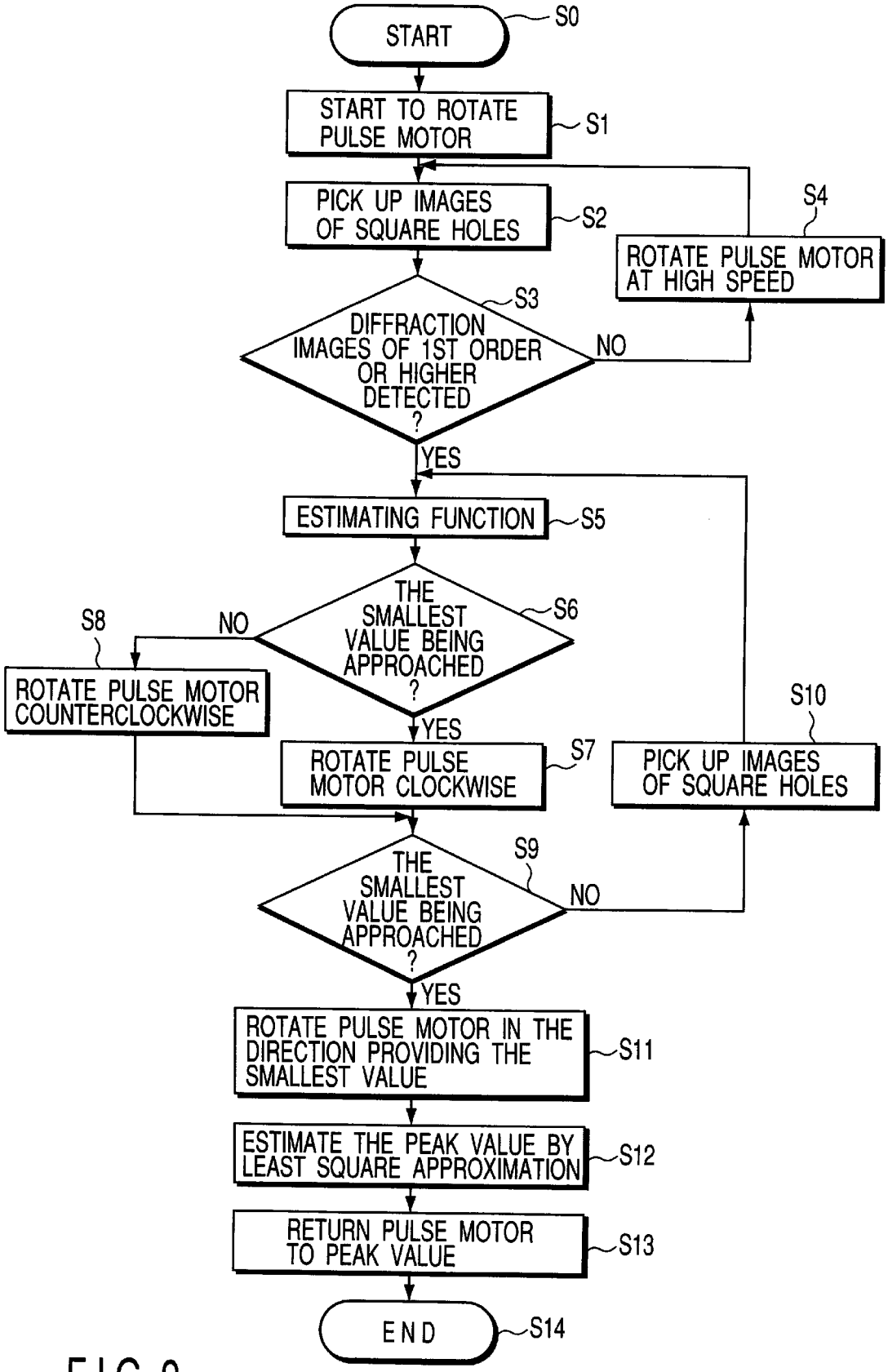
FIG. 9 is a flowchart for the operation of the control system of FIG. 6.

Next, the steps of positioning the electron gun assembly 12 will be explained by reference to FIG. 9.

Before the electron gun assembly 12 is positioned, a bulb transfer head is stopped and the bulb is held in a specific position by the holding unit. After the bulb has been held, positioning is started at step S0. When the positioning operation has been started, the pulse motor 40 is moved forward in the j—j direction and its output gear 41 is engaged with the gear 38, which prepares the pulse motor 40 to start to rotate. If the pulse motor 40 is rotated, the rotating mechanism 32 will rotate the rotating adjustment table 18 on which the electron gun assembly 12 has been mounted, centered on the tube axis Z—Z.

Figure 10:
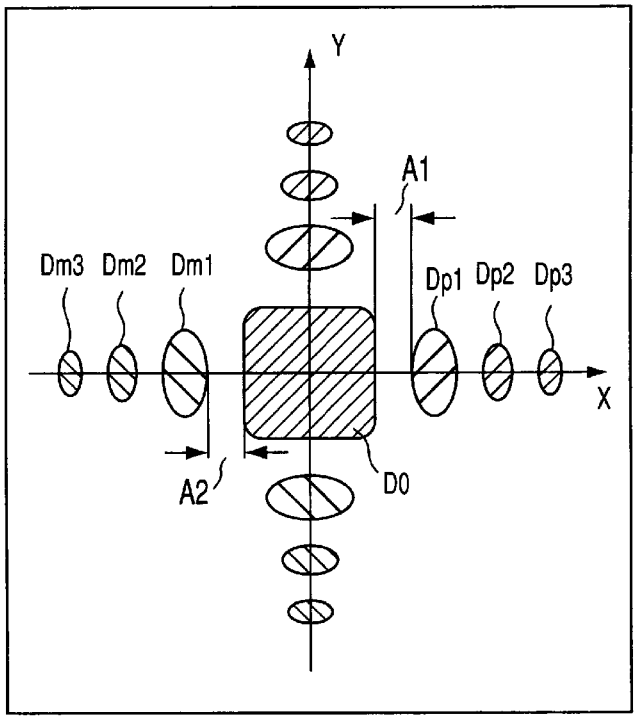
FIG. 10 is a plan view showing an estimating function used in the process of FIG. 9.

Next, the light source (not shown) that generates a laser beam is energized and emits a laser beam 17 from one side pointing at the pair of square holes 14, 14 made in the electron gun assembly 12. At this time, as shown in step S1, the pulse motor 40 is actuated and the electron gun assembly 12 starts to rotate on tube axis Z—Z via the adjustment screw 35 and actuating strip 33. After the electron gun assembly 12 has started to rotate, the CCD camera 45 of FIG. 6 provided on the other side of the pair of square holes 14, 14 senses the laser beam 17. As shown in step S3, when the laser beam has not been sensed, or when the laser beam has been sensed but neither the zero-order diffraction image nor diffraction images of the first order or higher (the first order and the second order) have been sensed, the pulse motor 40 is driven at high speed as shown in step S4 and then step S2 and step S3 are repeated. As shown in FIG. 10, the electron gun assembly 12 is rotated to the position at which not only the zero-order diffraction image D0 but also diffraction images of the first order or higher Dp1, Dp2, Dp3, Dm1, Dm2, and Dm3, particularly the first-order and second-order diffraction images Dp1, Dp2, Dm1, and Dm2, are sensed. Whether or not diffraction images of the first order or higher in the direction of x as well as the zero-order diffraction image is judged by sensing whether bright images in the direction of x, for example, two bright images corresponding to the first-order diffraction images, are formed centered on the bright image corresponding to the zero-order diffraction image. Specifically, the arithmetic and logic unit counts the number of the bright images and judges whether the count has exceeded a predetermined number.

The diffraction pattern picked up by the CCD camera 45 is inputted as an image signal to the image processing unit 46, which processes the signal. The image-processed diffraction pattern signal is supplied to the arithmetic and logic unit 43, which performs arithmetic operations. When the sensed diffraction pattern becomes a preset desired pattern, or the pattern as shown in FIG. 10 (or when diffraction images of the first order or higher have been sensed), a control unit 44 gives a stop instruction to the pulse motor 40, thereby stopping the driving of the rotating mechanism 32, which stops the rotation of the electron gun assembly 12.

When at step S3, the first-order and second-order diffraction images have been sensed in the diffraction pattern picked up by the CCD camera 45, the zero-order diffraction image D0 corresponding to the square hole 14 in the large circle located in the center and diffraction images of the first order, second order, . . . adjacent to the diffraction image D0 in right-to-left symmetry are produced in sequence. When diffraction images of the first order or higher are produced together with the zero-order image D0, the laser beam 17 is parallel with imaginary line X—X connecting the pair of square holes 14, 14 or almost parallel with imaginary line X—X in a permissible range. In this state, an estimating function is found at step S5 so that the laser beam 17 may be parallel exactly with imaginary line X—X connecting the pair of square holes 14, 14.

Figure 11:
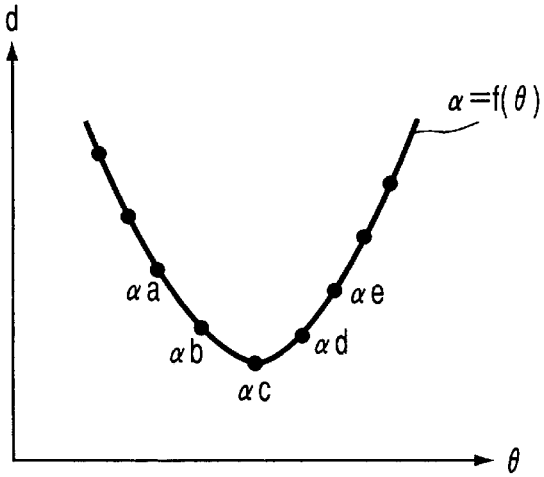
FIG. 11 is a graph showing an estimating function representing the relationship between the angle of the electron gun assembly and the diffraction pattern in the apparatus of FIG. 5.

The estimating function, which is shown in FIG. 11, expresses the relationship between the distances $\alpha 1$, $\alpha 2$ from the center of the large circle (the zero-order diffraction image) in the middle to the centers of the adjacent circles (the first-order diffraction images) in the direction of x and the rotational angle $\theta$ of the electron gun assembly 12. The arithmetic and logic unit 43 determines the distances $\alpha 1$, $\alpha 2$ by measuring the distances between the center of the zero-order diffraction image and the centers of the adjacent first-order diffraction images on both sides more than once in real time and averaging the measurements. The rotational angle $\theta$ of the electron gun assembly 12 is proportional to the number of pulses applied to the pulse motor 40. The number of pulses may be converted into the rotational angle $\theta$ by calculation. Alternatively, the number of pulses may be made a function of the rotational angle $\theta$ as the index for the rotational angle $\theta$. The distances $\alpha 1$, $\alpha 2$ and rotational angle $\theta$ are stored in a memory 48 as an estimating function. As explained by reference to FIG. 8, when the rotating adjustment table 18 is stopped at the rotational angle at which the distances $\alpha 1$, $\alpha 2$ are the smallest, or the rotational angle at which diffraction images of the desired pattern were produced, this means that the laser beam 17 is exactly parallel with imaginary line X—X connecting the pair of square holes 14, 14. The estimating function is used to estimate the positioning.

In FIG. 11, the distance $\alpha a$ is determined at the initial position of the electron gun assembly 12 by measuring one of the center-to-center distances $\alpha 1$, $\alpha 2$ or measuring both of them and averaging the measurements. Next, the electron gun assembly 12 is rotated clockwise through, for example, the rotational angle $\theta b$ and the distance $\theta b$ is determined. Because the distance $\alpha a$ is smaller than the distance $\alpha b$ ($\alpha a > \alpha b$), the electron gun assembly 12 is rotated clockwise. Similarly, the electron gun assembly 12 is rotated clockwise through the rotational angles $\theta c$, $\theta d$, $\theta e$, . . . and the distance $\theta c$, $\theta d$, $\theta e$, . . . are determined. These data items are stored as an estimating function in the memory 48.

At step S6, if the curve of the estimating function is evaluated and the rotational angle $\theta$ at which the distance a is the smallest is used, the laser beam 17 will be made parallel with imaginary line X—X. This will make it possible to rotate the electron gun assembly from the initial position in a clockwise direction and judge whether the value of the distance $\alpha$ gets closer to the smallest value. When the value approaches the smallest value, the pulse motor 40 rotates the electron gun assembly 12 clockwise as shown in step S7.

On the other hand, in a case where the value of the distance $\alpha$ becomes larger even when the electron gun assembly is rotated clockwise from the initial position, the electron gun assembly 12 is rotated counterclockwise and the pulse motor 40 is driven in the direction in which the distance $\alpha$ becomes the smallest. At step S9, it is judged whether the smallest value has been exceeded. If the smallest value has not been exceeded, the CCD camera 45 will pick up the diffraction pattern of the laser beam 17 as shown in step S10, and step S5 to step S9 will be repeated. If it has been judged at step S9 that the smallest value has been exceeded, the pulse motor 40 will be rotated toward the smallest value as shown in step S11.

The estimating function may be determined by rotating the electron gun assembly 12 from the initial position to a specific rotational position in a specific direction, then getting data on rotational positions while rotating the electron gun assembly 12 in the opposite direction from the specific rotational position, and calculating the distance.

After the estimating function including the smallest value is obtained in the above steps, the smallest value $\alpha m$ is estimated from the estimating function using least square approximation and the rotational position of the electron gun assembly 12 corresponding to the smallest value $\alpha m$ is determined. Namely, the rotational angle $\theta m$ corresponding to the smallest value $\alpha m$ is calculated. Thereafter, as shown in step S13, the electron gun assembly 12 is rotated to the position of the rotational angle $\theta m$ at which the distance $\alpha$ has the smallest value $\alpha m$. At that position, the electron gun assembly 12 is held in place and the positioning is completed as shown in step S14.

Figure 3:
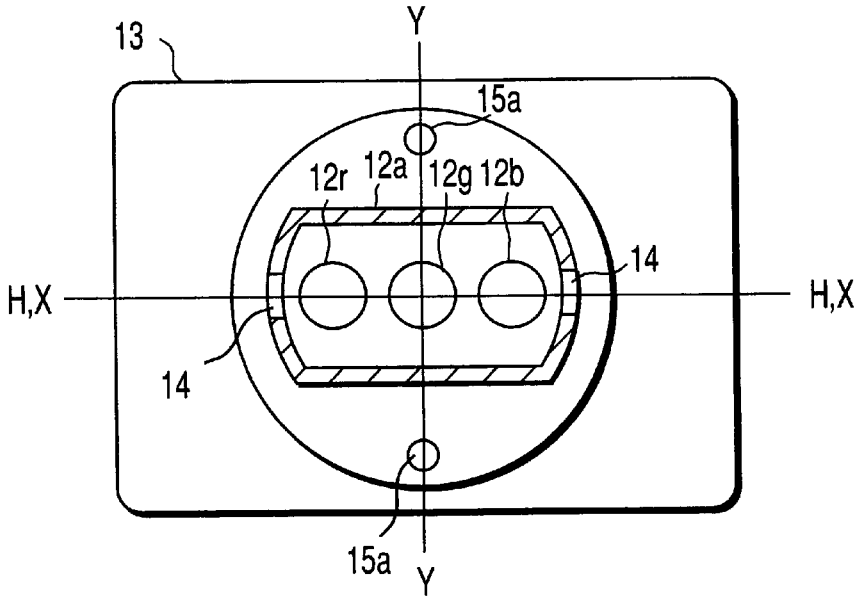
FIG. 3 is a plan view showing a state where the bulb is aligned with the electron gun assembly of FIG. 1.
Figure 4:
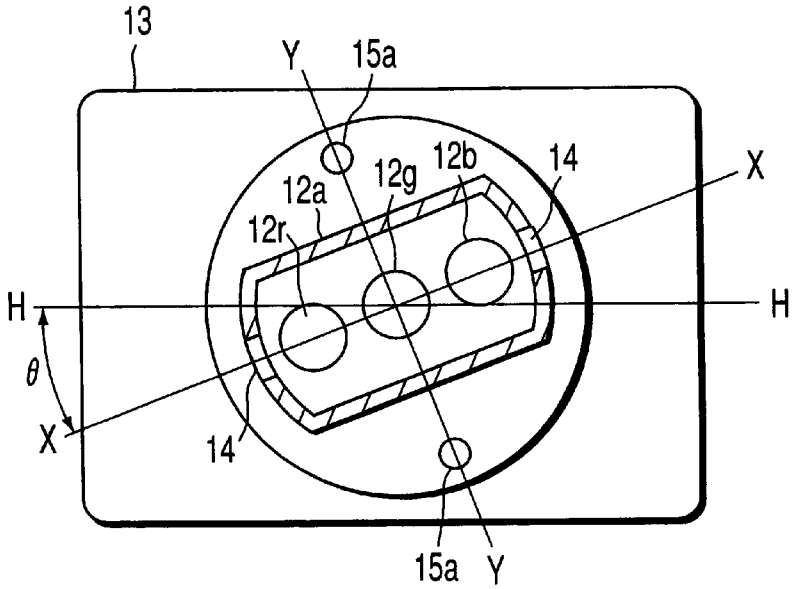
FIG. 4 is a plan view showing a state where the bulb and electron gun assembly of FIG. 1 incline, causing a twist error.

As described above, in the course of rotation, the electron gun assembly never fails to pass the point at which the distance $\alpha$ is the smallest. The pulse motor 40 is returned to the peak value so that the distance $\alpha$ becomes the smallest, which eventually causes imaginary line H—H to align with imaginary line X—X as shown in FIG. 3.

Figure 1:
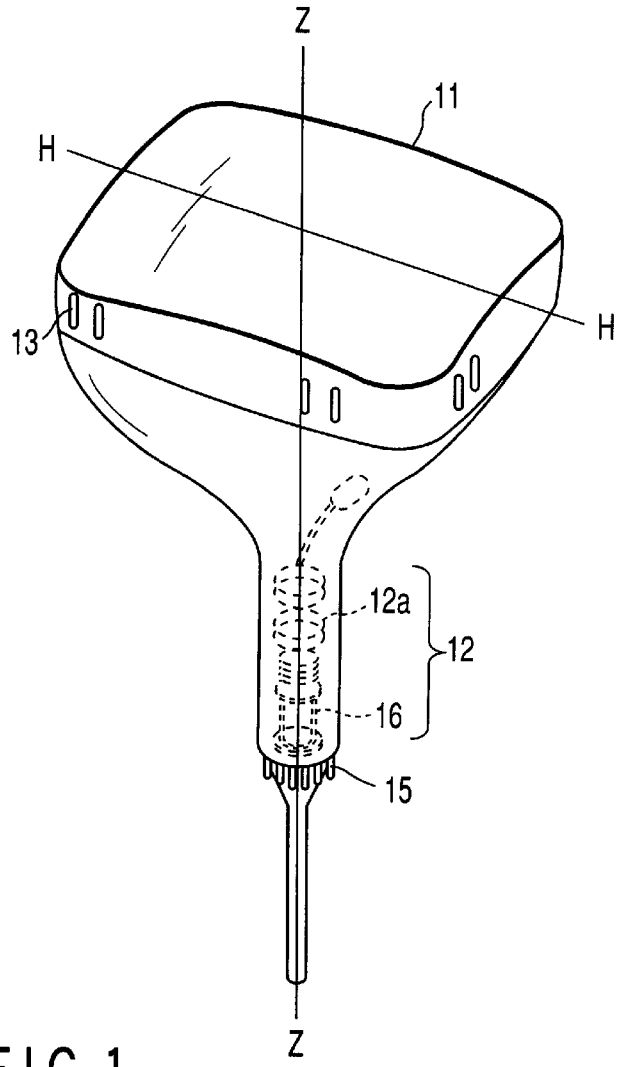
FIG. 1 is a schematic perspective view showing the configuration of a color cathode-ray tube before an exhaust process.
Figure 2:
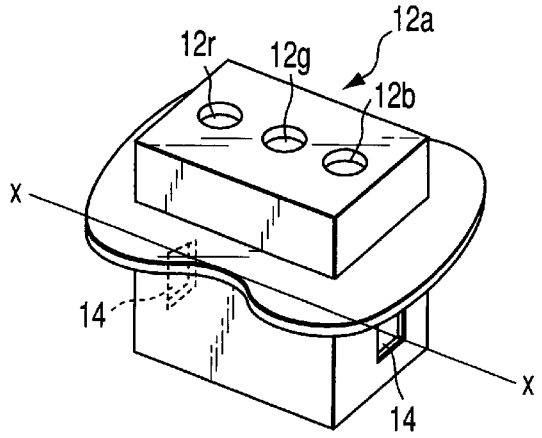
FIG. 2 is a perspective view of an electron gun electrode built in the neck of the color cathode-ray tube of FIG. 1.

After the positioning, a moving mechanism (not shown) causes the pulse motor 40 to separate the output gear 41 from the gear 38. Thereafter, a driving mechanism (not shown) drives the mount rod 22 upward, raising the flange 19 and rotating adjustment table 18 at the top using the pair of stanchion rods 23 as a guide, which inserts the electron gun assembly 12 on the rotating adjustment table 18 into the neck portion of the bulb 11 held suitably in position by a holding unit (not shown). Thereafter, the bulb is sealed. By those operations, the color cathode-ray tube of FIG. 1 is manufactured.

In the process of the estimating function shown in FIG. 11, the zero point sensitivity can be improved by differentiating the function once, which enables more accurate positioning.

While the estimating function has been determined by measuring the distance between the center A0 of the zero-order diffraction image of square hole 14 of FIG. 8 and the center A1 or center A2 of the first-order diffraction images, it may be determined by measuring the distance A1 between the right edge of the zero-order diffraction image D0 and the left edge of the first-order diffraction image Dp1 or it may be determined by measuring the distance A2 between the left edge of the zero-order diffraction image D0 and the right edge of the first-order diffraction image Dm1. Furthermore, it may be determined by measuring the distance between the center A1 and center A2 of the first-order diffraction images of FIG. 8. In this case, too, the positioning may be done by minimizing the distance between the center A1 and center A2 of the first-order diffraction images. Furthermore, making use of second-order diffraction images appearing next to the first-order diffraction images, the positioning may be done by determining an estimating function for the relationship between the center A1 or A2 of the first-order diffraction images and the center A3 or A4 of the second-order diffraction images or between the center A0 of the zero-order diffraction image and the center A3 or A4 of the second-order diffraction images and then minimizing those distances. It is apparent that the estimating function may be determined based on the side-to-side distance between the diffraction images instead of the center-to-center distance between the diffraction images.

As described above, since the electron gun assembly can be placed in the desired position automatically and accurately at high speed using the estimating function, the highly accurate sealing of the electron gun assembly can be realized without human intervention.

While in the embodiment, rotation is adjusted before the electron gun assembly is inserted into the neck portion of the bulb, positioning may be done after the electron gun assembly is inserted into the neck portion.

With the present invention, because the electron gun assembly is placed in the desired position with respect to the bulb automatically and accurately at high speed using diffraction images of a laser beam produced according to the rotational angle of the electron gun assembly, the highly accurate sealing of the electron gun assembly is realized without human intervention and the rotation of the electron gun assembly varies less, which realizes a high-quality color cathode-ray tube.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode-ray tube sealing method of positioning an electron gun assembly with a pair of positioning holes facing each other with respect to the screen of a color cathode-ray tube with a tube axis and sealing the assembly in the neck portion of said color cathode-ray tube, comprising the steps of:

rotating the electron gun assembly on the tube axis of said color cathode-ray tube;

emitting a laser beam from one hole of the electron gun assembly and allowing the beam to pass through the pair of holes, with the electron gun assembly in the rotated state;

receiving a diffraction pattern produced by the laser beam passed through the holes;

acquiring data on the relationship between the distance between specific diffraction images and the rotation of the electron gun assembly in a state where specific diffraction images are sensed in the received diffraction pattern; and determining from the acquired data the rotational position of said electron gun assembly at which the distance between specific diffraction images is the smallest and holding said electron gun assembly in that position.

2. The color cathode-ray tube sealing method according to claim 1, wherein said holes are square holes.

3. The color cathode-ray tube sealing method according to claim 1, wherein said distance between specific diffraction images corresponds to the distance between a zero-order diffraction image and a first-order diffraction image.

4. The color cathode-ray tube sealing method according to claim 1, wherein said distance between specific diffraction images corresponds to the distance between first-order diffraction images.

5. The color cathode-ray tube sealing method according to claim 1, wherein said distance between specific diffraction images corresponds to the distance between first-order diffraction image and second-order diffraction image.

6. A color cathode-ray tube sealing apparatus which positions an electron gun assembly with a pair of positioning holes facing each other with respect to the screen of a color cathode-ray tube with a tube axis and seals the assembly in the neck portion of said color cathode-ray tube, said color cathode-ray tube sealing apparatus comprising:

rotating means for rotating the electron gun assembly on the tube axis of said color cathode-ray tube;

laser beam emitting means for emitting a laser beam from one side to the holes in the electron gun assembly;

sensing means for receiving the laser light passed through the other of said holes and sensing the resulting diffraction pattern;

an image processing unit for processing the image signal of the diffraction pattern from the sensing means; and an arithmetic operation unit for determining the rotational position of said electron gun assembly by performing arithmetic operations on the diffraction pattern processed by the image processing unit, calculating the distance between diffraction images with a preset desired diffraction image sensed in the diffraction pattern, and controlling said rotating means so that the distance may become the smallest.

7. The color cathode-ray tube sealing apparatus according to claim 6, wherein said holes are square holes.

8. The color cathode-ray tube sealing apparatus according to claim 6, wherein said distance between specific diffraction images corresponds to the distance between a zero-order diffraction image and a first-order diffraction image.

9. The color cathode-ray tube sealing apparatus according to claim 6, wherein said distance between specific diffraction images corresponds to the distance between first-order diffraction images.

10. The color cathode-ray tube sealing apparatus according to claim 6, wherein said distance between specific diffraction images corresponds to the distance between first-order diffraction image and second-order diffraction image.

11. A method of causing a laser beam to pass through a pair of holes facing each other made in an object to be rotated and sensing the resulting diffraction pattern, comprising the steps of:

judging whether specific diffraction images have appeared in the sensed diffraction pattern;

calculating the distance between the diffraction images from the sensed diffraction pattern when the specific diffraction images have appeared;

storing data on the correlation between the distance between the diffraction images and the rotational position of the object to be rotated; and finding from the stored data the rotational position at which the distance between the diffraction images is the smallest and determining the position.

12. An object rotational-position determining system for causing a laser beam to pass through a pair of holes facing each other made in an object to be rotated and sensing the resulting diffraction pattern, comprising:

means for judging whether specific diffraction images have appeared in the sensed diffraction pattern;

means for calculating the distance between the diffraction images from the sensed diffraction pattern when the specific diffraction images have appeared;

means for storing data on the correlation between the distance between the diffraction images and the rotational position of the object to be rotated; and means for finding from the stored data the rotational position at which the distance between the diffraction images is the smallest and determining the position.

* * * * *